United States Patent [19]

Astolfi

[11] 4,235,030

[45] Nov. 25, 1980

[54] ASSEMBLY IN TWO PARTS WITH WHICH TO CONSTRUCT FRAMES

[75] Inventor: Pietro Astolfi, Casalecchio, Italy

[73] Assignee: Pico-Glass S.n.c. di Beatrice Huber & C., Bologna, Italy

[21] Appl. No.: 15,881

[22] Filed: Feb. 27, 1979

[30] Foreign Application Priority Data

May 23, 1978 [IT] Italy ..... 3448 A/78

[51] Int. Cl.[3] ..... G09F 1/12

[52] U.S. Cl. ..... 40/156; 40/152

[58] Field of Search ..... 40/156, 152, 152.1, 40/154, 155, 158 A, 209

[56] References Cited

U.S. PATENT DOCUMENTS

| | | | |
|---|---|---|---|
| 2,106,203 | 1/1938 | Ashe | 40/156 |
| 3,797,795 | 3/1974 | Hemgren | 40/156 X |

FOREIGN PATENT DOCUMENTS

| | | | |
|---|---|---|---|
| 2637144 | 3/1977 | Fed. Rep. of Germany | 40/156 |
| 1536121 | 12/1978 | United Kingdom | 40/156 |

*Primary Examiner*—John F. Pitrelli

*Attorney, Agent, or Firm*—Mason, Fenwick & Lawrence

[57] ABSTRACT

Disclosed herein is an assembly in two parts with which to construct frames for pictures, prints and photographs, et cetera.

The said two component parts are: a wooden or similar or plastic material strip that extends longitudinally and is essentially rectangular in shape, this having over the full length thereof a slit that is also rectangular; and an essentially V shaped body that can be elastically deformed and is provided with two U shaped limbs, each of which defines a tooth.

With this particular assembly it is extremely easy both to insert the subject to be framed and to eventually replace it with another.

2 Claims, 11 Drawing Figures

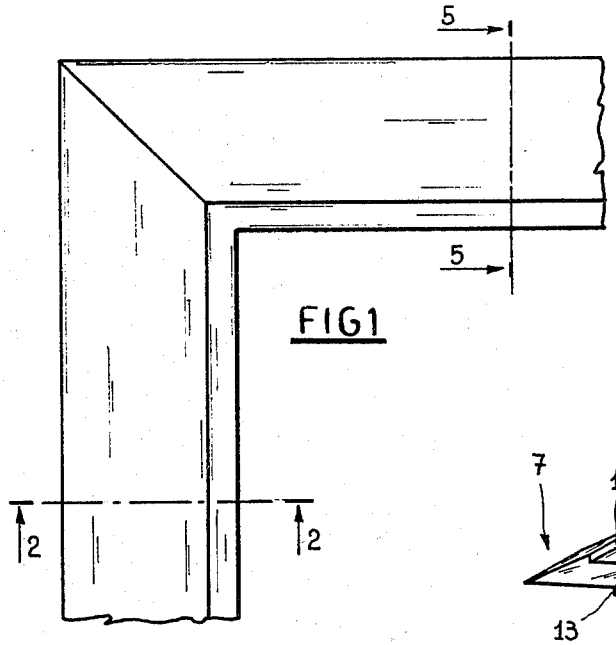
FIG1
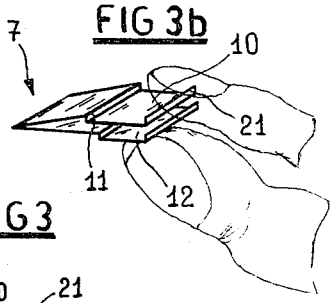
FIG 3b
FIG3
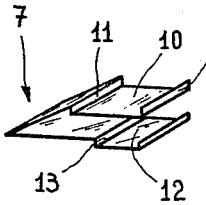
FIG3a
FIG2
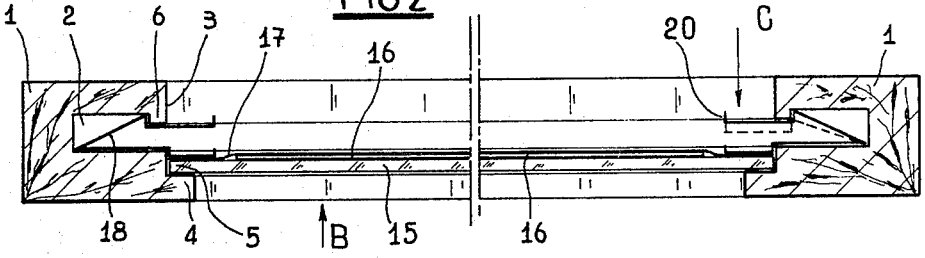
FIG4a
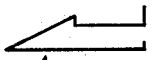
7
FIG4b
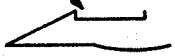
FIGc
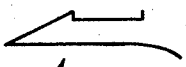
7
FIGe
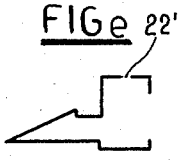
22
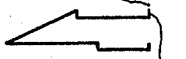
21
FIG4d
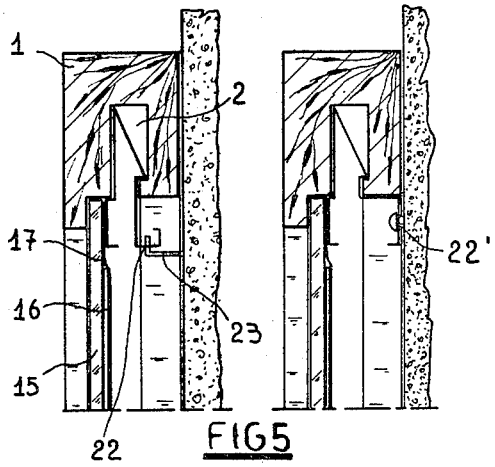
FIG5

ASSEMBLY IN TWO PARTS WITH WHICH TO CONSTRUCT FRAMES

BACKGROUND OF THE INVENTION

This invention relates to an assembly in two parts with which to construct frames.

DESCRIPTION OF THE PRIOR ART

As is known, to frame a picture, a print, a photograph or any reproduction suited to the purpose, frames are utilized that consist of strips of various shapes and materials (generally wood), theoretically infinite in length, which are cut to the required length corresponding to the dimensions of the subject to be framed, these being fastened one to the other in the region of their vertices. Subsequently the glass, the background that forms a margin around the subject being framed, and the picture or print itself are inserted, with everything being locked in the frame by means of nails. The customary practice is to then seal the back of the frame with a sheet of paper.

It is obvious that the construction of a frame as described above is particularly complicated and that it calls for the use of suitable personnel and the necessary equipment.

Another commonly adopted method is to have a frame in which the subject is locked by means of a flat, thin, sheet of material (usually plywood, card or plastic), the dimensions of which are roughly identical to the area delimitated by the said frame, the said sheet of material being inserted at the back of the frame, in a corresponding housing, and then locked therein with the use of metal clips pivoted rotatably to the frame. This method also has various disadvantages, the first of these being the possibility of the said sheet of material buckling as time goes by, and the weight of the complete frame.

SUMMARY OF THE INVENTION

The essential object of the present invention is to make available an assembly in two parts with which to construct frames and by means of which it is possible, with extreme ease, to mount the picture or print, etcetera, as well as to replace this with other similar ones, and for this to be done by any person, in an extremely short space of time, without the need for any equipment. The foregoing is achieved by a method that is particularly simple and is, above all, economical, of a reduced weight and is such as to maintain its characteristics constant with the passing of time.

These and other objects too are all attained with the assembly forming the subject of the present invention, essential features of which are that it comprises: a first part that constitutes the frame itself, essentially longitudinal in extension, with an internal slit extending over the full length thereof and placed in communication with the outside along the inner side of the said frame, the said part being provided, over the full length thereof, with a projection which, together with the inner side and the said slit, defines a housing (5) designed to accept the subject or the subjects to be framed, and with a contact surface made along the said slit at a point almost corresponding to the inner side of the frame but on the opposite side to the said projection; and a second part constituted by two elongated limbs that meet at one extremity and, due to elastic deformation, can be inserted into the inside of the said slit, the said second part being provided, at least in the region of one limb, with a tooth that can be coupled firmly to the said contact surface, the second limb fitting flush against the subject or the subjects to be framed.

BRIEF DESCRIPTION OF THE DRAWINGS

Further characteristics and advantages of the invention in question will emerge more obviously from the following detailed description of one preferred form of embodiment, illustrated purely as an unlimited example on the accompanying drawing, in which:

FIG. 1 shows, in a diagrammatic view from the rear, one example of a frame constructed with the assembly in two parts forming the subject of the present invention;

FIG. 2 shows the same frame as in FIG. 1, along a cross section (2—2);

FIGS. 3*a* and 3*b* show, in a diagrammatic perspective view, one of the parts constituting the assembly in question;

FIGS. 4*a*–4*e*, show, diagrammatically, examples that are alternatives to the method illustrated in FIG. 3;

FIG. 5 shows, diagrammatically, the frame in question, along a section (5—5) in FIG. 1, with different hanging possibilities.

DESCRIPTION OF THE PREFERRED EMBODIMENT

With reference to the accompanying figures and, in particular, to FIGS. 1 and 2, there is a first part (1) consisting of a strip (of wood or similar, or of plastic material, etcetera) that extends longitudinally, is essentially of rectangular section, and has internally, over the full length thereof, a holding slot (2) which is also of rectangular section and communicates externally through an access slit with a side (3) of the said first part, which constitutes the inner side of the resulting frame.

The said first part is provided at the front, with respect to what can be seen in FIG. 2 along a view from (B), with a positioning ledge in the form of a projection (4) that defines, together with the said side (3), a housing (5) designed to accept the subject or the subjects to be framed, as will be seen better hereinafter.

Corresponding to where the inner side of the said first part is positioned, on the opposite side to the aforementioned projection (4), an abutment surface which in this particular case is constituted by one side of a tooth (6), which separates slot (2) from side (3). An access slit is provided beneath the tooth (6) so that the surface of the tooth (6) and the access slit define the inward extent of the holding slot 2 with the access slit providing communication from the interior of the frame to the holding slot 2.

FIG. 3 illustrates the second component of the invention which is used in conjunction with the first component (1) and comprises a mounting clip 7 of spring-like metal or plastic material so as to be capable of resiliently bending. Clip 7 includes a V-shaped body normally positioned within the holding slot 2 with an upper U-shaped section 10 extending from the end of an inclined panel 18 and which includes a positioning tooth 11 engageable with the inner surface of tooth 6 for holding the clip in position as shown in FIG. 2. Additionally, clip 7 includes a lower U-shaped section 12 extending from the edge of a bottom panel component of the V-shaped body and having a positioning tooth 13 engageable with the inner surface of side 3 of the frame. Positioning of teeth 11 and 13 and the spring-like quality of the clip insure a secure positioning and holding of the clip in the position illustrated in FIG. 2. It should be observed that the inclined panel 18 of the clip is flexible and elastic and can be bent so as to provide force on teeth 11 and 13 for retaining the clip in position by reactive force with the frame member (1). The edge of the upper U-shaped section 10 positioned inside the periphery of the frame comprises an edge flange 20 as shown in FIG. 2.

Removal of clip 7 from the internal holding slot 2 is effective simply by pressing the flange 20 downwardly to the dotted line position illustrated in FIG. 2 so that the clip can then be removed from frame element (1) toward the interior of the frame (to the left) with respect to the righthand clip of FIG. 2.

The tooth (11) is intended to fit flush against the corresponding tooth (6) in the slit (2).

An analysis will now be given of the stages in the mounting of a subject to be framed: the frame shown in FIG. 1 is previously prepared, as depicted, in the standardized required dimensions, through the end-to-end union of four strips that go to make up the said first part (1).

Assuming that it is wished to frame a photograph, all that has to be done is to insert the glass (15) flush with and slotted into the housing (5), to place the photograph (16) (see FIG. 2) in contact with the glass, and then a card (17) which serves as the background that forms a margin around the subject being framed, after which everything is locked through the insertion, inside the slot (2) and at certain points along the sides of the frame, from the inside, of the said clip (7).

The latter, because of the inclined panel (18), is compressed through elastic deformation (as can be seen in FIG. 3*b*) until it slides into holding slot (2) so that tooth (11) is flush up against the corresponding tooth (6). This is the condition in which the U shaped section (12) presses against the card (17) to ensure that the subject framed therein is locked perfectly.

In an extremely simple way it is possible to withdraw the second part (7) from the slit (2). To do this, one has only to press on the folded back edge flange (20), in the direction of the arrow (C), as shown in the dotted line configuration in FIG. 2, and the teeth (11) and (6) are released from one another, thereby freeing the glass (15), the photograph (16) and the card (17).

It is obvious that in the event of it being wished to frame pictures, for example made of plywood, or subjects of a certain thickness, either the glass can be dispensed with or use can be made of clips (7) of various shapes, as illustrated diagrammatically in FIGS. 4*a*, 4*b* and 4*c*, suitable for the purpose.

Finally in FIG. 5 two possible examples for hanging the frame are shown. In this connection, a slot (22) provided to have a nail (23) fixed in the wall supporting the frame slotted into it, can be made in the folded back section of the clip (7). The same also applies as regards the slot (22') in FIG. 4*e*.

In its practical embodiment, the invention can also be in forms differing from what has been described above and, in particular, numerous modifications of a practical nature can be made without in any way deviating from the framework of protection afforded to the present invention.

What is claimed is

1. A picture frame assembly including an elongated strip having an inwardly facing side, from which a positioning ledge extends, an internal holding slot extending along the length of said elongated strip, an abutment surface defining an upper portion of the inner extent of said holding slot, an access slit communicating the remaining portion of the inner extent of said holding slot with the inwardly facing side of the elongated strip, clip means including a V-shaped portion positioned in said holding slot and including a spring-like panel extending diagonally across said holding slot and joined at an apex to a bottom panel engaged with the bottom of the slot, a downwardly extending upper tooth connected to the end of the spring-like panel opposite the apex and engaging the abutment surface and a downwardly extending lower tooth extending downwardly from the edge of the bottom panel opposite the apex for engaging an inwardly facing surface of the elongated strip and clamping means extending inwardly from the lower tooth toward the interior of the frame for planar engagement with planar items mounted in the frame externally of the inwardly facing side of the frame and urging said planar items toward said positioning ledge.

2. The picture frame assembly of claim 1 additionally including panel means extending toward the interior of the frame from the lower end of the upper tooth to permit removal of the clip by deflecting the upper tooth downwardly to a position out of contact with the abutment surface to permit removal of the clip from the holding slot via the access slit.

* * * * *